US009108447B1

(12) United States Patent
Komiya

(10) Patent No.: US 9,108,447 B1
(45) Date of Patent: Aug. 18, 2015

(54) PRINTER

(71) Applicant: BROTHER KOGYO KABUSHIKI KAISHA, Nagoya-shi (JP)

(72) Inventor: Hidekazu Komiya, Nagoya (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 14/477,270

(22) Filed: Sep. 4, 2014

(30) Foreign Application Priority Data

Jan. 24, 2014 (JP) ..... 2014-011164

(51) Int. Cl.
*B41J 2/01* (2006.01)
*B41J 25/308* (2006.01)
*B41J 11/20* (2006.01)

(52) U.S. Cl.
CPC ..... *B41J 11/20* (2013.01); *B41J 25/308* (2013.01); *B41J 25/3088* (2013.01)

(58) Field of Classification Search
CPC .. B41J 25/308; B41J 25/3082; B41J 25/3088; B41J 11/20; B41J 11/007; B41J 11/06; B41J 11/02
See application file for complete search history.

(56) References Cited

U.S. PATENT DOCUMENTS

2008/0129813 A1* 6/2008 Park et al. ..... 347/198

FOREIGN PATENT DOCUMENTS

JP 2006-240107 A 9/2006

* cited by examiner

*Primary Examiner* — Lisa M Solomon
(74) *Attorney, Agent, or Firm* — Fox Rothschild LLP

(57) ABSTRACT

A printer includes an ejection portion configured to eject liquid, a flat plate-shaped platen arranged at a distance from the ejection portion, a support portion configured to support the platen, a pair of rails extending in a first direction, a movement portion configured to move in the first direction along the pair of rails, a connection portion configured to connect the support portion and the movement portion, and an adjustment mechanism configured to connect the support portion and the movement portion via the connection portion, allowing adjustment of an arrangement of the support portion with respect to the pair of rails. The adjustment mechanism includes at least three sets of adjustment portions, each of the at least three sets of adjustment portions including a penetration portion, a screw hole and a screw.

5 Claims, 6 Drawing Sheets

PRINTER

CROSS-REFERENCE TO RELATED APPLICATION

This application claims priority to Japanese Patent Application No. 2014-011164, filed Jan. 24, 2014, the content of which is hereby incorporated herein by reference in its entirety.

BACKGROUND

The present disclosure relates to a printer that is configured to perform printing by ejecting liquid onto a print medium that is arranged on a flat plate-shaped platen.

A printer is known that includes a platen and a liquid ejection portion. The platen is configured to support a print medium (a cloth, for example) from below. The printer is configured to perform printing on the print medium by moving the platen in a direction orthogonal to a movement direction of the liquid ejection portion. In this type of printer, it may be desirable that the distance from the liquid ejection portion to the platen be constant with respect to any portion of the whole platen. This is to inhibit printing quality from deteriorating due to displacement of a landing position of liquid ejected from the liquid ejection portion. To address this, for example, a printer is known that includes support members and screw members as a mechanism for adjusting a horizontal inclination of the platen. The support members are arranged between a platen mounting member and the platen. The screw members are configured to fasten the platen to the platen mounting member. Three or more of the support members are provided. At least two of the support members are elastic members. At least two of the support members are arranged substantially in parallel with the movement direction of the platen or the movement direction of the liquid ejection portion. Two or more of the screw members are provided. With the printer, an operator can adjust the horizontal inclination of the platen with respect to the platen mounting member, by adjusting a fastening condition of each of the screw members.

SUMMARY

The operation of adjusting the horizontal inclination of the platen while adjusting the fastening condition of each of the screw members may be complicated, depending on an inclined state of the platen. In the printer, there may be a case in which the horizontal inclination between the platen and a shaft portion that supports the platen can be adjusted. In this case, the shaft portion may be assembled into a support portion of the printer after the horizontal inclination of the shaft portion with respect to the platen has been adjusted. At this time, there may be a case in which the distance between the platen and the liquid ejection portion is not constant due to a mechanical error or the like in the support portion. In this case, the operator may need to perform the horizontal adjustment of the platen and the shaft portion once again, so that the distance from the liquid ejection portion to the platen is constant with respect to any portion of the whole platen.

Various embodiments of the broad principles derived herein provide a printer that may allow adjusting both a distance between a pair of rails and a platen that is configured to move along the pair of rails, and an inclination of the platen with respect to the pair of rails, with a simple operation.

Various embodiments herein provide a printer that includes an ejection portion, a flat plate-shaped platen, a support portion, a pair of rails, a movement portion, a connection portion, and an adjustment mechanism. The ejection portion is configured to eject liquid. The flat plate-shaped platen is arranged at a distance from the ejection portion. The support portion is configured to support the platen. The pair of rails extend in a first direction. The movement portion is configured to move in the first direction along the pair of rails. The connection portion is configured to connect the support portion and the movement portion. The connection portion includes a first connection portion and a second connection portion. The adjustment mechanism is configured to connect the support portion and the movement portion via the connection portion, allowing adjustment of an arrangement of the support portion with respect to the pair of rails. The adjustment mechanism includes at least three sets of adjustment portions. Each of the at least three sets of adjustment portions includes a penetration portion, a screw hole and a screw. The penetration portion penetrates one of the connection portion and a connection target in a second direction. The screw hole is formed in the other of the connection portion and the connection target and extending in the second direction. The connection target is one of the support portion and the movement portion. The second direction is a direction orthogonal to the first direction. The screw hole has a diameter that is smaller than a length in a long side direction of the penetration portion. The screw has a head portion whose diameter is larger than a length in a short side direction of the penetration portion. The penetration portions or the screw holes of at least two sets of the at least three sets of adjustment portions are provided in the first connection portion, and the penetration portion or the screw hole of at least one set of the at least three sets of adjustment portions is provided in the second connection portion.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the accompanying drawings. In the embodiment, an inkjet printer (hereinafter, simply referred to as a printer) 1 that is configured to perform printing on a cloth, such as a T-shirt, will be explained.

A schematic structure of the printer 1 will be explained with reference to FIG. 1. The printer 1 is a printer that is configured to perform printing by print heads 13 on a cloth (a T-shirt, for example), which is a print medium, using liquid (ink, for example) that is supplied from cartridges 7. The up-down direction, the lower right direction, the upper left direction, the lower left direction and the upper right direction of FIG. 1 respectively correspond to the up-down direction, the front direction, the rear direction, the left direction and the right direction of the printer 1 and the cartridges 7.

Figure 1:
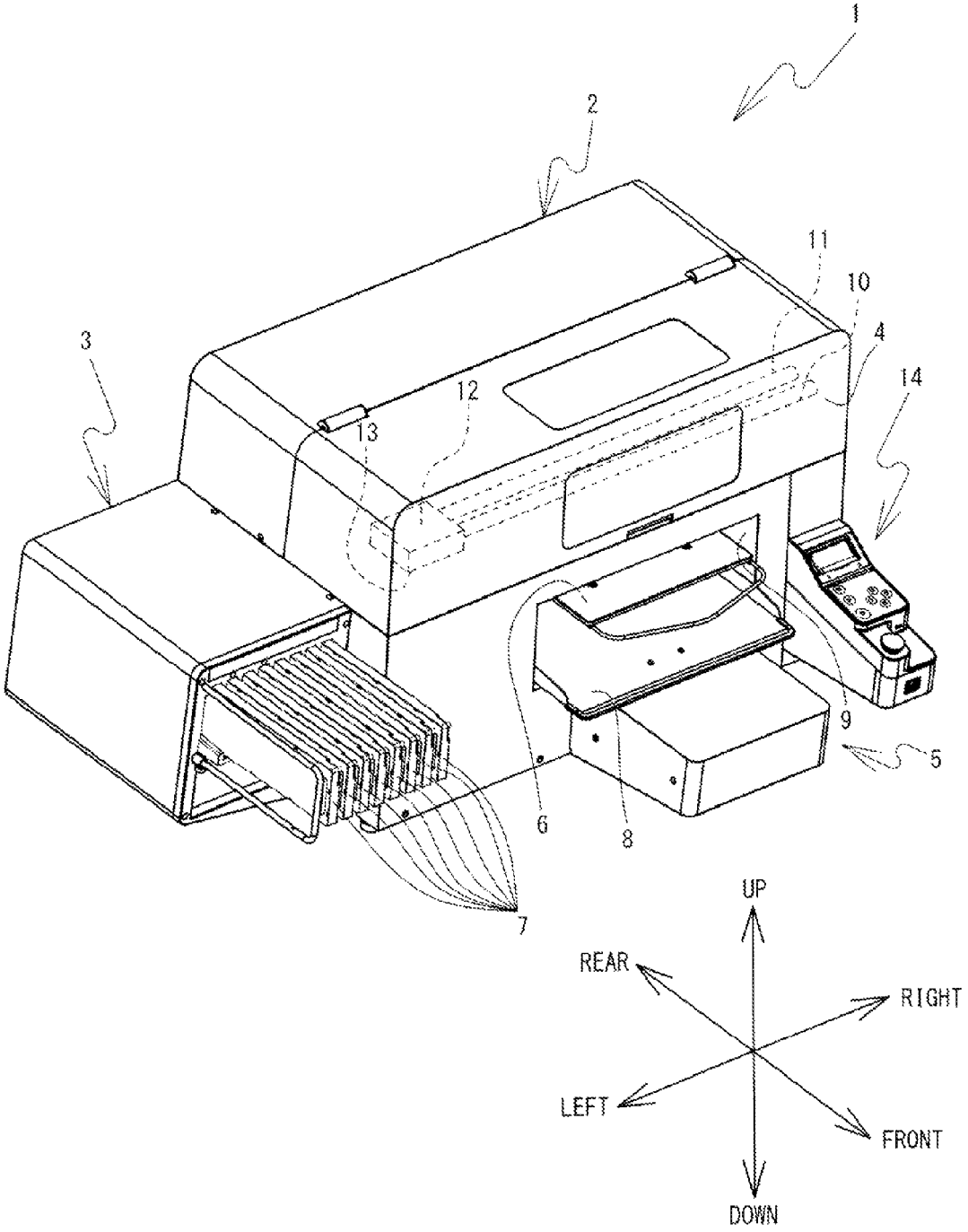
FIG. 1 is a perspective view of a printer.

As shown in FIG. 1, the printer 1 includes a main body 2 and a cartridge mounting unit 3. The main body 2 is a portion in which is performed printing by the print heads 13 while the print medium is moved. The main body 2 will be described in more detail later. An operation portion 14 is provided on a lower right portion of the front surface of the main body 2. The operation portion 14 has a display that is configured to display various types of information, and buttons etc. that may be used to input commands relating to various operations of the printer 1. The cartridge mounting unit 3 is a portion in which the cartridges 7 that are configured to supply liquid to the print heads 13 are mounted. The cartridge mounting unit 3 has a substantially cuboid shape that is smaller than the main body 2. The cartridge mounting unit 3 is detachably mounted on a lower portion of the left side of the main body 2. A total of eight of the cartridges 7 can be mounted in the cartridge mounting unit 3 of the present embodiment. Normally, the eight cartridges 7 include the four cartridges 7 for white ink, and the cartridges 7 for respective four colors of ink, namely, cyan, magenta, yellow and black inks.

Figure 2:
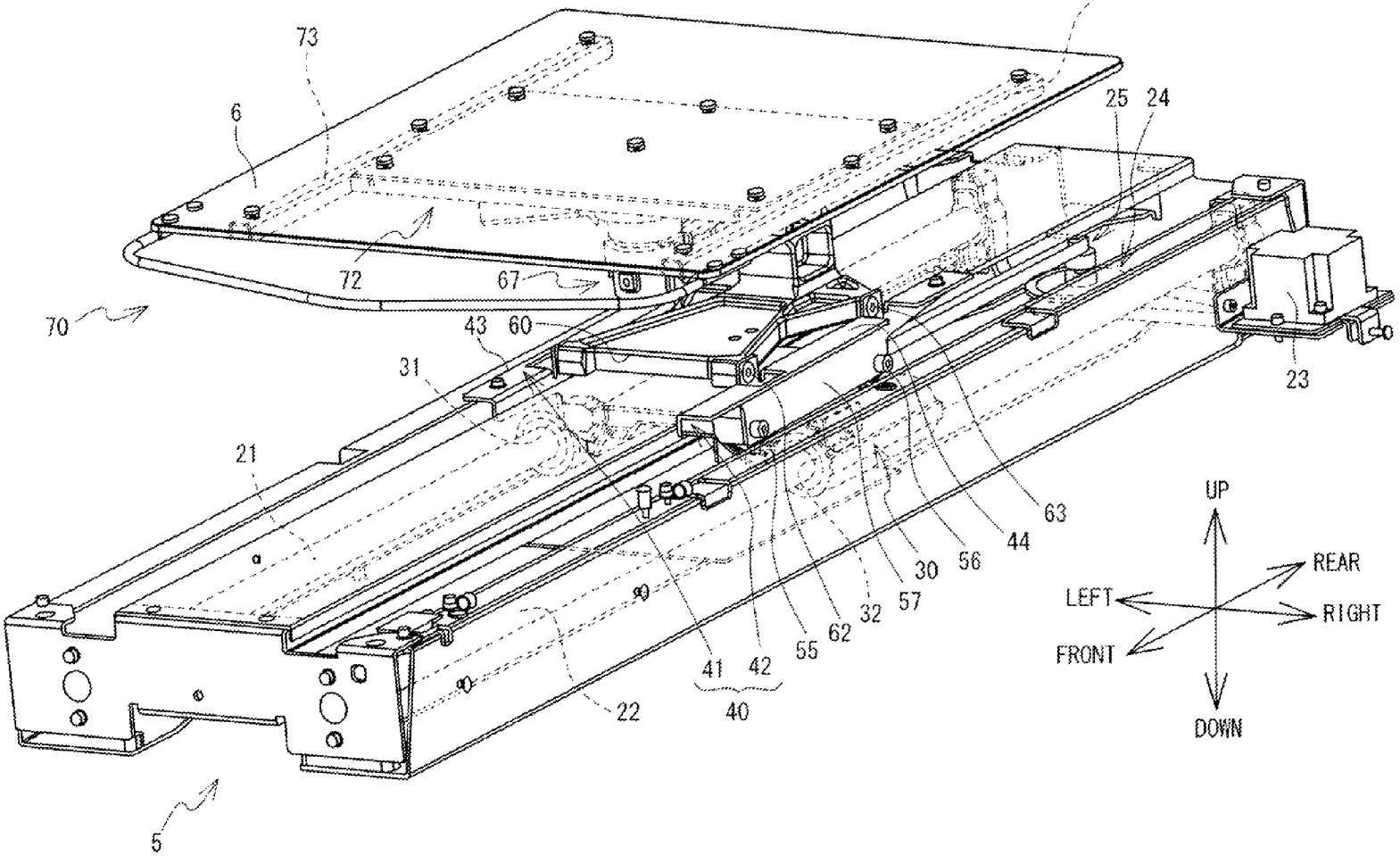
FIG. 2 is a perspective view of a drive mechanism, a movement portion, a connection portion, a support portion and a platen unit.

The main body 2 includes a cuboid-shaped housing 4. As shown in FIG. 1 and FIG. 2, the main body 2 includes a drive mechanism 5, a movement portion 30, a connection portion 40, a support portion 60 and a platen unit 70, in a central portion of the main body 2 in the left-right direction. As shown in FIG. 2, the drive mechanism 5 includes a pair of rails 21 and 22, a drive motor 23 and belt transmission mechanisms 24 and 25. The drive mechanism 5 is a mechanism that is configured to move the movement portion 30 along the pair of rails 21 and 22, using the drive motor 23 as a power source. The pair of rails 21 and 22 are column-shaped rods that extend in parallel with each other, with a predetermined distance therebetween. In the present embodiment, the pair of rails 21 and 22 extend in the front-rear direction of the printer 1, with the predetermined distance therebetween in the left-right direction. The belt transmission mechanisms 24 and 25 are configured to transmit the driving force of the drive motor 23 to the movement portion 30.

Figure 3:
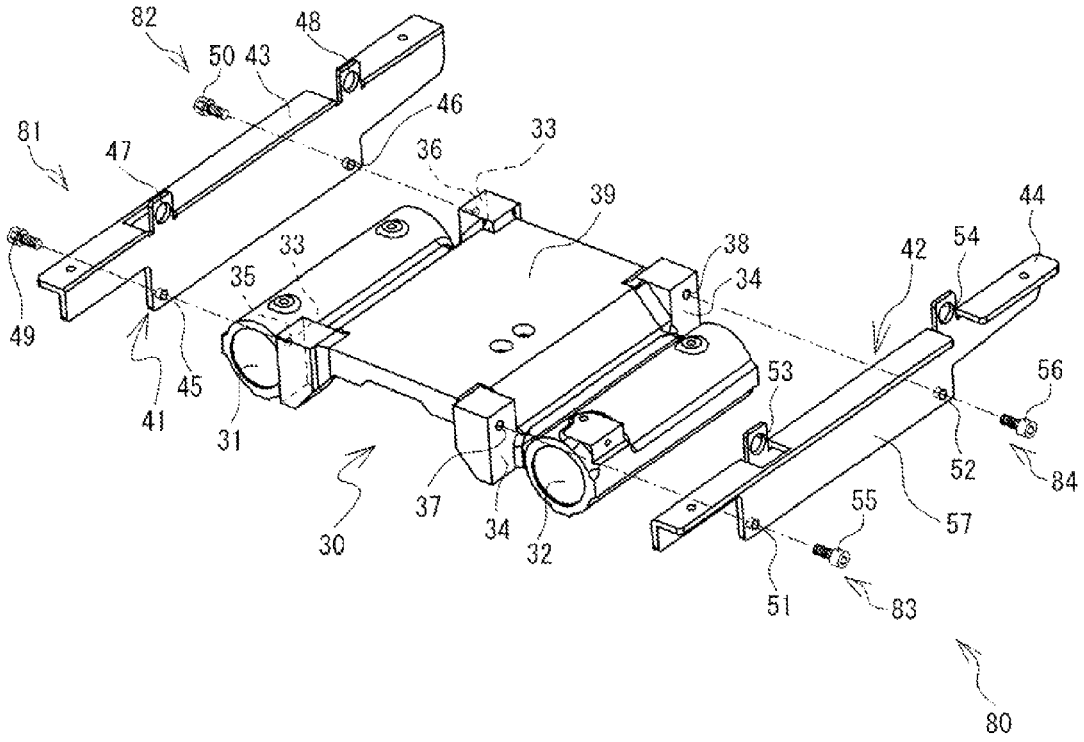
FIG. 3 is an exploded perspective view of the movement portion, the connection portion and an adjustment mechanism.

The movement portion 30 is connected to the support portion 60 via the connection portion 40. As shown in FIG. 3, the movement portion 30 has a pair of through holes 31 and 32 that penetrate in the front-rear direction and that are provided with a predetermined distance therebetween in the left-right direction. The pair of rails 21 and 22 are inserted though the through holes 31 and 32, respectively. The movement portion 30 is configured to be moved along the pair of rails 21 and 22 by the drive mechanism 5. The movement portion 30 has screw holes 35 and 36 that extend in the left-right direction, in an upper front end portion and an upper rear end portion of a left wall portion 33, respectively. The movement portion 30 has screw holes 37 and 38 that extend in the left-right direction, in an upper front end portion and an upper rear end portion of a right wall portion 34, respectively.

As shown in FIG. 2, the connection portion 40 is configured to connect the movement portion 30 and the support portion 60. The connection portion 40 includes a left-side connection portion 41 and a right-side connection portion 42. As shown in FIG. 3, each of the left-side connection portion 41 and the right-side connection portion 42 is a member that is formed such that an upper portion of a plate-shaped metal member that extends in the front-rear direction is folded substantially at a right angle toward the opposite side to the support portion 60 side. The folded sections of the left-side connection portion 41 and the right-side connection portion 42 are engagement support portions 43 and 44, respectively, that are folded substantially at a right angle toward the opposite side to the support portion 60 side and that extend in the left-right direction. The engagement support portions 43 and 44 engage with a tray 8 (refer to FIG. 1) that will be described later, and support the tray 8.

The left-side connection portion 41 has through holes 45 and 46 that penetrate in the left-right direction, in positions corresponding to the screw holes 35 and 36. The through holes 45 and 46 are arranged on the lower side with respect to the engagement support portion 43 (arranged on the side of the pair of rails 21 and 22). The left-side connection portion 41 has through holes 47 and 48 that penetrate in the left-right direction, in positions corresponding to a lower front end portion and a lower rear end portion of the left side surface of the support portion 60. The through holes 47 and 48 are arranged on the upper side with respect to the engagement support portion 43 (arranged on the platen 6 side). Each of the through holes 45 to 48 has a circular shape in a left side view.

A screw 49 is inserted through the through hole 45 and is screwed into the screw hole 35. The screw 49, the through hole 45 and the screw hole 35 form an adjustment portion 81. The diameter of the through hole 45 is smaller than the diameter of a head portion of the screw 49, and is larger than the diameter of the screw 49 (the diameter of the screw hole 35). Although not shown in the drawings, the end face of the head portion of the screw 49 is positioned to the left of the left side surface of the left-side connection portion 41. In a similar manner, a screw 50 is inserted through the through hole 46 and is screwed into the screw hole 36. The screw 50, the through hole 46 and the screw hole 36 form an adjustment portion 82. The diameter of the through hole 46 is smaller than the diameter of a head portion of the screw 50, and is larger than the diameter of the screw 50 (the diameter of the screw hole 36). Although not shown in the drawings, the end face of the head portion of the screw 50 is positioned to the left of the left side surface of the left-side connection portion 41.

In a similar manner, the right-side connection portion 42 has through holes 51 and 52 that penetrate in the left-right direction, in positions corresponding to the screw holes 37 and 38. The through holes 51 and 52 are arranged on the lower side with respect to the engagement support portion 44 (arranged on the side of the pair of rails 21 and 22). The right-side connection portion 42 has through holes 53 and 54 that penetrate in the left-right direction, in positions corresponding to a lower front end portion and a lower rear end portion of the right side surface of the support portion 60. The through holes 53 and 54 are arranged on the upper side with respect to the engagement support portion 44 (arranged on the platen 6 side). Each of the through holes 51 to 54 has a circular shape in a right side view.

Figure 4:
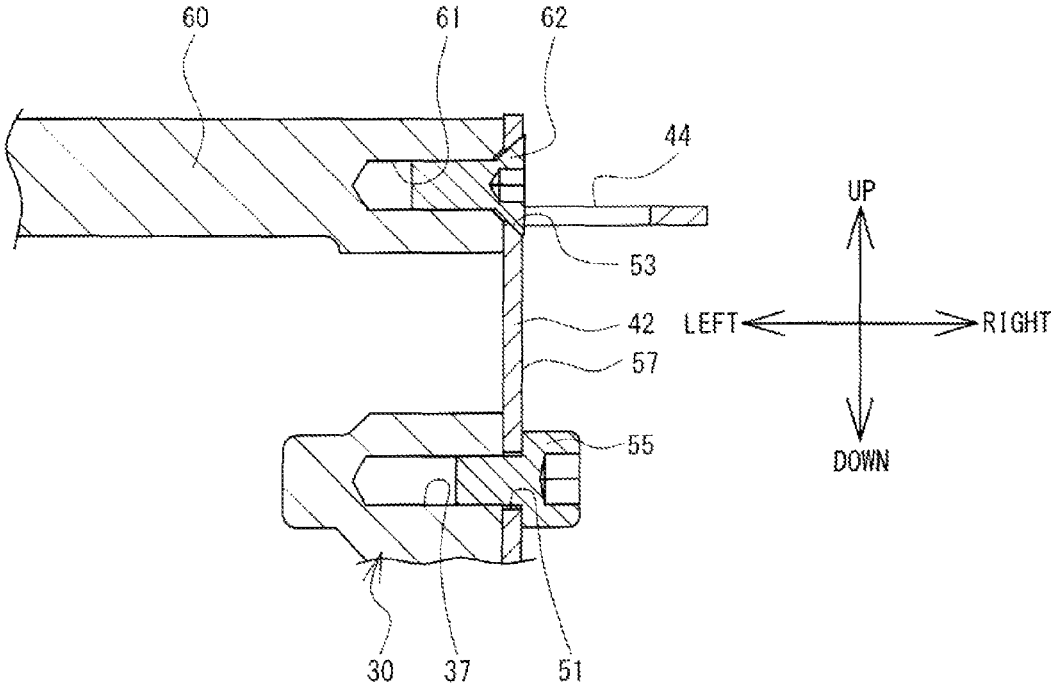
FIG. 4 is an enlarged cross-sectional view of a right-side connection portion and peripheral portions thereof.

A screw 55 is inserted through the through hole 51 and is screwed into the screw hole 37. The screw 55, the through hole 51 and the screw hole 37 form an adjustment portion 83. The diameter of the through hole 51 is smaller than the diameter of a head portion of the screw 55, and is larger than the diameter of the screw 55 (the diameter of the screw hole 37). As shown in FIG. 4, the end face of the head portion of the screw 55 is positioned to the right of a right side surface 57 of the right-side connection portion 42. In a similar manner, a screw 56 is inserted through the through hole 52 and is screwed into the screw hole 38. The screw 56, the through hole 52 and the screw hole 38 form an adjustment portion 84. The diameter of the through hole 52 is smaller than the diameter of a head portion of the screw 56, and is larger than the diameter of the screw 56 (the diameter of the screw hole 38). As shown in FIG. 2, the end face of the head portion of the screw 56 is positioned to the right of the right side surface 57 of the right-side connection portion 42.

The four sets of the adjustment portions 81 to 84 form an adjustment mechanism 80. Among the four sets of the adjustment portions 81 to 84, two sets of the adjustment portions 81 and 82 are both arranged on the left wall portion 33 side such that they are spaced from each other in the front-rear direction. The adjustment portion 81 is located on the front end side of the pair of rails 21 and 22, and the adjustment portion 82 is located on the rear end side of the pair of rails 21 and 22. In a similar manner, two sets of the adjustment portions 83 and 84 are both arranged on the right wall portion 34 side such that they are spaced from each other in the front-rear direction. The adjustment portion 83 is located on the front end side of the pair of rails 21 and 22, and the adjustment portion 84 is located on the rear end side of the pair of rails 21 and 22.

The adjustment mechanism 80 is configured to connect the support portion 60 and the movement portion 30 via the connection portion 40 such that the arrangement of the support portion 60 with respect to the pair of rails 21 and 22 can be adjusted. A relationship between the diameter of the screws 49, 50, 55 and 56 and the diameter of the through holes 45, 46, 51 and 52 in the adjustment portions 81, 82, 83 and 84 may be determined while taking into consideration the accuracy when the arrangement of the support portion 60 with respect to the pair of rails 21 and 22 is adjusted. Specifically, the relationship between the diameter of the screws 49, 50, 55 and 56 and the diameter of the through holes 45, 46, 51 and 52 may be determined while taking into consideration a manufacturing error of a component located between the platen 6 and the rails 21 and 22, a distance between the adjustment portion 81 and the adjustment portion 82, and a size of the platen 6. In the present embodiment, the diameter of each of the screws 49, 50, 55 and 56 is 6 millimeters (mm). The diameter of the head portion of each of the screws 49, 50, 55 and 56 is 10 millimeters (mm). The diameter of each of the through holes 45, 46, 51 and 52 is 6.5 to 7.5 millimeters (mm). A method for adjusting the arrangement of the support portion 60 with respect to the pair of rails 21 and 22 by the adjustment mechanism 80 will be described later.

As shown in FIG. 2, the support portion 60 is configured to support the platen unit 70. The support portion 67 includes a mounting portion 67 that is provided on an upper portion on the front side of the support portion 60. A shaft portion 71 of the platen unit 70, which will be described later, is detachably mounted on the mounting portion 67. When the drive mechanism 5 moves the movement portion 30, the platen unit 70 mounted on the mounting portion 67 moves along the pair of rails 21 and 22, together with the movement portion 30 and the support portion 60.

Screw holes 61 (refer to FIG. 4) that extend in the left-right direction are provided in the lower front end portion and the lower rear end portion of the right side surface of the support portion 60. The illustration of the screw hole in the lower rear end portion is omitted. Screw holes (not shown in the drawings) that extend in the left-right direction are provided in the lower front end portion and the lower rear end portion of the left side surface of the support portion 60. As shown in FIG. 4, a countersunk screw 62 is inserted through the through hole 53 and is screwed into the screw hole 61 of the support portion 60. The through hole 53 is formed in a taper shape such that the diameter thereof decreases toward the screw hole 61 in accordance with the shape of a head portion of the countersunk screw 61. As shown in FIG. 4, the end face of the head portion of the countersunk screw 62 is substantially on the same plane as the right side surface 57 of the right-side connection portion 42. In a similar manner, a countersunk screw 63 (refer to FIG. 2) is inserted through the through hole 54 (refer to FIG. 3) and is screwed into the screw hole in the lower rear end portion of the right side surface of the support portion 60. In a similar manner to the through hole 53, the through hole 54 is formed in accordance with the shape of a head portion of the countersunk screw 63. The end face of the head portion of the countersunk screw 63 is substantially on the same plane as the right side surface 57 of the right-side connection portion 42. Although not shown in the drawings, in a similar manner, countersunk screws are screwed into two screw holes provided in the left side surface of the support portion 60) via the through holes 47 and 48, respectively.

Figure 5:
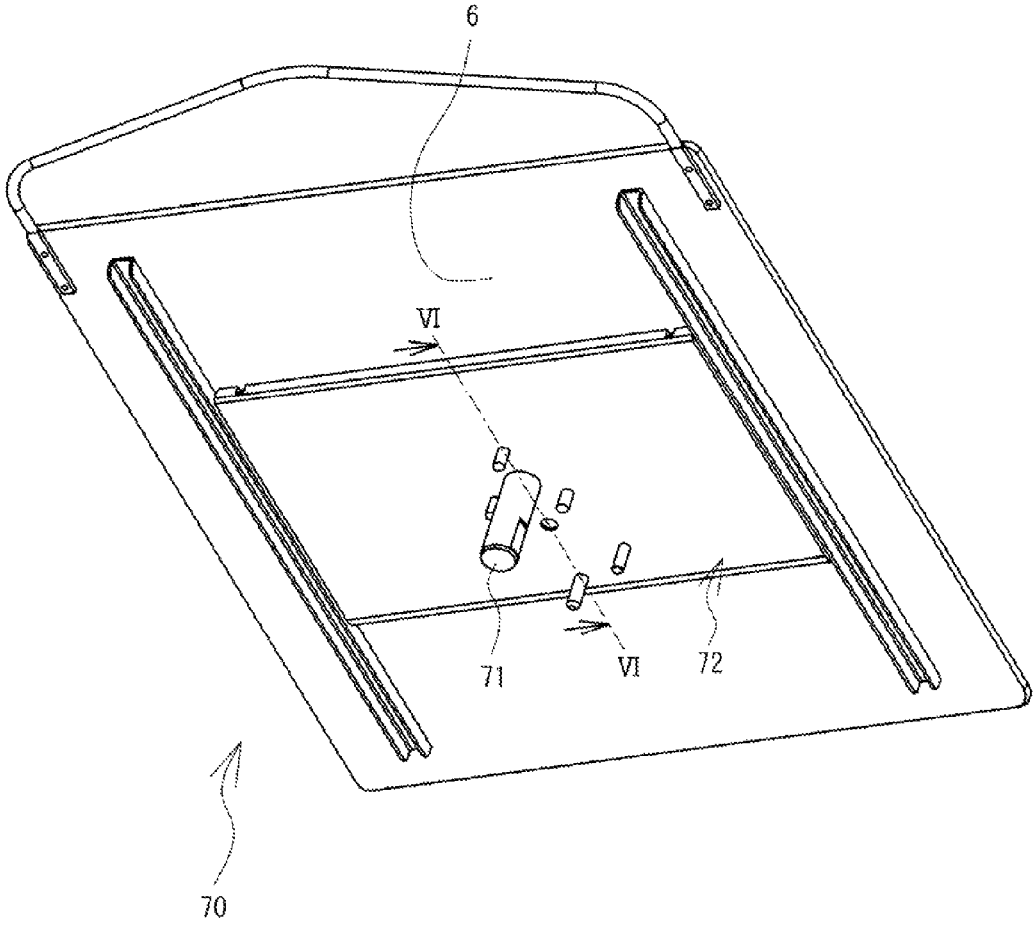
FIG. 5 is a perspective view of the platen unit when viewed from below.

As shown in FIG. 5, the platen unit 70 includes the platen 6, the shaft portion 71 and an adjustment portion 72. The platen 6 is a flat plate-shaped member that has a substantially rectangular shape whose long sides extend in the front-rear direction. The platen 6 may be formed of acrylic resin, for example. The platen 6 is arranged such that it is separated from the print heads 13. The cloth, which is the print medium, may be placed on a top surface 599 (refer to FIG. 6) of the platen 6, namely, on a surface that opposes the print heads 13. The shaft portion 71 supports the platen 6. The shaft portion 71 extends downward (toward the side of the pair of rails 21 and 22) from the vicinity of a central portion of the platen 6, substantially perpendicular to the platen 6.

Figure 6:
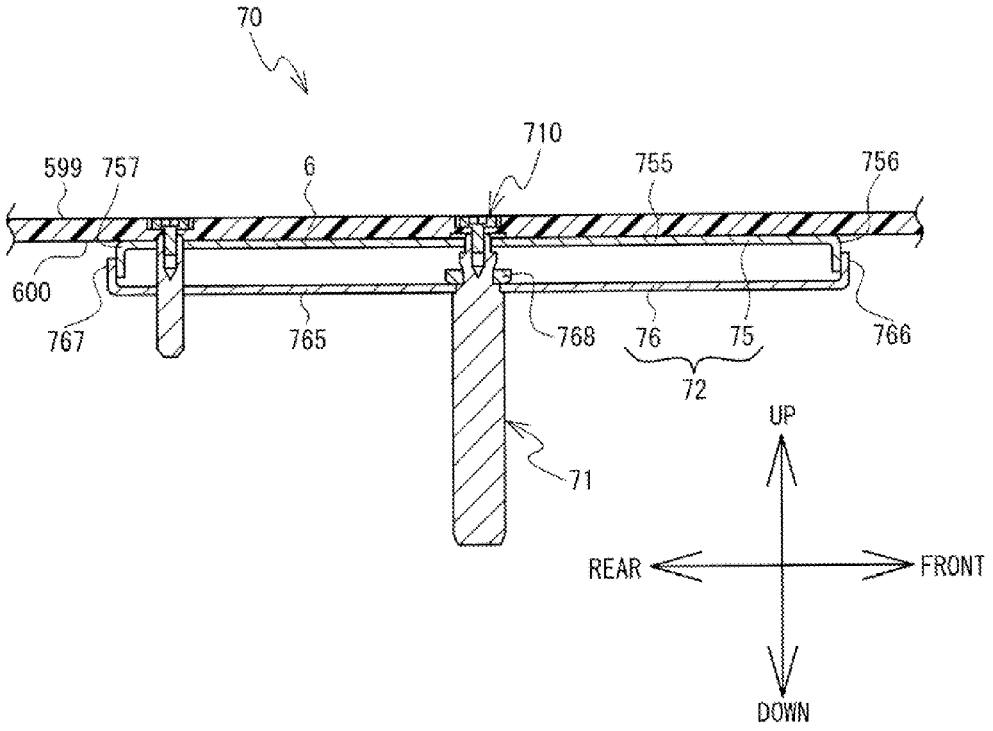
FIG. 6 is a cross-sectional view taken in the direction of arrows along a line VI-VI shown in FIG. 5.

The adjustment portion 72 can adjust the inclination of the platen 6 with respect to the shaft portion 71. As shown in FIG. 6, the adjustment portion 72 includes a first adjustment portion 75 and a second adjustment portion 76. The first adjustment portion 75 is formed by processing a metal plate to have an inverted U shape in a side view. The first adjustment portion 75 has a fixed portion 755 and a pair of wall portions 756 and 757. The fixed portion 755 has a rectangular flat plate shape whose long sides extend in the left-right direction in a plan view. The fixed portion 755 is connected to a lower surface 600 of the platen 6 using screws (not shown in the drawings). The pair of wall portions 756 and 757 extend toward the shaft portion 71 side (i.e., downward) from both end portions in a predetermined direction (the front-rear direction in the present embodiment) of the fixed portion 755. The second adjustment portion 76 is formed by processing a metal plate to have a U shape in a side view. The second adjustment portion 76 has a fixed portion 765 and a pair of wall portions 766 and 767. The fixed portion 765 has a rectangular flat plate shape whose long sides extend in the left-right direction in a plan view. In the present embodiment, the upper end of the shaft portion 71 is inserted through the second adjustment portion 76 and the first adjustment portion 75, in that order, from below, and is fixed to the platen 6 by a screw 710. The fixed portion 765 (the second adjustment portion 76) is fixed to the shaft portion 71 by a nut 768. The pair of wall portions 766 and 767 extend toward the platen 6 side (i.e., upward) from both end portions in the predetermined direction (the front-rear direction in the present embodiment) of the fixed portion 765. The pair of wall portions 766 and 767 are arranged on the outer side of the pair of wall portions 756 and 757, respectively, and face the pair of wall portions 756 and 757. The adjustment portion 72 is configured to adjust the inclination of the shaft portion 71 with respect to the platen 6. More specifically, by adjusting the arrangement of the second adjustment portion 76 with respect to the first adjustment portion 75, it is possible to adjust the inclination of the shaft portion 71 with respect to the platen 6. The adjustment portion 72 may include an adjustment mechanism (not shown in the drawings) that is similar to the adjustment mechanism 80, for example.

In this case, after the arrangement of the second adjustment portion 76 with respect to the first adjustment portion 75 is adjusted, the wall portion 766 and the wall portion 756 may be connected by a screw (not shown in the drawings), and the wall portion 767 and the wall portion 757 may be connected by a screw (not shown in the drawings).

As shown in FIG. 1, the tray 8 is arranged below the platen 6, substantially in parallel with the platen 6. The tray 8 is a plate-shaped member that is larger on all sides than the platen 6. The tray 8 is engaged with the top surfaces of the engagement support portions 43 and 44 (refer to FIG. 2) and is supported. The tray 8 is configured to inhibit a part of the print medium (a sleeve or the like of a T-shirt) placed on the platen 6 from falling downward. As shown in FIG. 2, in the present embodiment, the pair of rails 21 and 22 extend in the front-rear direction above the belt transmission mechanisms 24 and 25, and are configured to guide the platen 6 and the tray 8. The drive motor 23 is configured to drive the belt transmission mechanisms 24 and 25. When the drive motor 23 drives the belt transmission mechanisms 24 and 25, the platen 6 and the tray 8 (refer to FIG. 1) supported by the movement portion 30 move in the front-rear direction along the rails 21 and 22. As shown in FIG. 1, the housing 4 of the main body 2 has an opening 9, in a central portion of the front surface thereof. The platen 6 and the tray 8 enter and exit the main body 2 via the opening 9.

The main body 2 includes a pair of rails 10 and 11, which are provided substantially at the center in the front-rear direction of the main body 2 and above the platen 6. The rails 10 and 11 are rod-shaped and extend in the left-right direction. More specifically, the rail 10 has a round rod shape that extends in the left-right direction. The rail 11 has a square rod shape that extends in the left-right direction, and has a square cross section that is perpendicular to the extending direction (the left-right direction) of the rail 11. The rails t) and 11 support a carriage 12. The print heads 13 are fixed to a lower portion of the carriage 12. The number of print heads 13 may vary depending on the type of an inkjet printer. The number of the print heads 13 of the printer 1 is eight. The carriage 12 may be moved in the left-right direction along the rails 10 and 11 by a carriage drive mechanism (not shown in the drawings). The carriage drive mechanism includes a carriage drive motor and a belt transmission mechanism. The eight cartridges 7 mounted in the cartridge mounting unit 3 respectively supply liquid to the eight print heads 13 via tubes (not shown in the drawings). Each of the print heads 13 has a plurality of very fine nozzles (not shown in the drawings). The print heads 13 are each configured to eject the liquid downward (toward the platen 6 side) in accordance with driving of piezoelectric elements of the nozzles. The printer 1 performs printing on the print medium by ejecting the liquid from the print heads 13 while moving the platen 6, on which the print medium is placed, and the carriage 12.

The method for adjusting the arrangement of the support portion 60 with respect to the pair of rails 21 and 22 by the adjustment mechanism 80 will be explained with reference to FIG. 2 to FIG. 4. In the adjustment portions 81 to 84 of the adjustment mechanism 80, the diameter of each of the through holes 45, 46, 51 and 52 is larger than the diameter of each of the corresponding screws 49, 50, 55 and 56. Therefore, by adjusting the arrangement of the through holes 45, 46, 51 and 52 with respect to the screws 49, 50, 55 and 56, it is possible to adjust the arrangement of the platen 6 with respect to the pair of rails 21 and 22. As an example, a case will be explained in which, when the printer 1 is manufactured, an operator adjusts the arrangement of the support portion 60 with respect to the pair of rails 21 and 22 using a jig (not shown in the drawings), and connects the connection portion 40 to the movement portion 30 and to the support portion 60.

First, the operator causes the rails 21 and 22 to be respectively inserted through the through holes 31 and 32 of the movement portion 30, from the front side. The operator fixes the arrangement of the mounting portion 67 of the support portion 60 with respect to the pair of rails 21 and 22 to a predetermined arrangement using the jig. In this state, the operator causes the shaft portion 71 of the platen unit 70 to be engaged with the mounting portion 67 of the support portion 60. The extending direction of the shaft portion 71 is maintained to be perpendicular to the extending direction of the pair of rails 21 and 22 by the jig. The operator connects the support portion 60 and the connection portion 40 using the countersunk screws 62 and 63 (the countersunk screws on the left side surface side are not shown in the drawings). The operator connects the connection portion 40 and the movement portion 30 using the screws 49, 50, 55 and 56 (refer to FIG. 3). The diameters of the screws 49, 50, 55 and 56 are smaller than the diameters of the through holes 45, 46, 51 and 52, respectively. Therefore, in the arrangement defined by the jig, the operator can screw the screws into the screw holes. With the above-described operations, the arrangement of the platen 6 with respect to the pair of rails 21 and 22 may be adjusted. More specifically, normally, when the shaft portion 71 is supported by the support portion 60, the connection portion 40 is connected to the movement portion 30 and to the support portion 60 in a posture in which the shaft portion 71 is at a right angle with respect to the pair of rails 21 and 22. Distances from the pair of rails 21 and 22 to the shaft portion 71 and to the support portion 60 become equal to distances that are prescribed by the jig. The operator pulls out the pair of rails 21 and 22, respectively, from the through holes 31 and 32 of the movement portion 30. The operator pulls out the shaft portion 71 from the support portion 60. The operator removes, from the jig, the movement portion 30 and the support portion 60 connected by the connection portion 40. The operator thus completes the adjustment operations.

In the printer 1, the arrangement of the platen 6 with respect to the pair of rails 21 and 22 can be easily adjusted by a single operation by using the adjustment mechanism 80. The arrangement of the platen 6 with respect to the pair of rails 21 and 22 includes both the distance between the platen 6 and the pair of rails 21 and 22 and the inclination of the platen 6 with respect to the pair of rails 21 and 22.

The platen unit 70, for which the horizontal adjustment of the platen 6 and the shaft portion 71 has been performed, may be mounted on the printer 1. In the platen unit 70 of the present embodiment, the operator can perform the horizontal adjustment of the platen 6 and the shaft portion 71 by using the adjustment portion 72. Even in this case, if a section of the printer 1 that supports the platen unit 70 is inclined due to a manufacturing error or the like, there is a possibility that the levelness of the platen 6 with respect to the pair of rails 21 and 22 is not appropriate when the platen unit 70 is mounted on the printer 1. With the printer 1 of the present embodiment, even in this type of case, it is not necessary for the operator to once more perform the adjustment of the platen 6 and the shaft portion 71 in the platen unit 70. The operator may use the adjustment mechanism 80 to adjust the levelness of the platen 6 with respect to the pair of rails 21 and 22, and thus can maintain a constant distance between the platen 6 and the print heads 13. In other words, in the printer 1, there is no need for the operator to perform the horizontal adjustment of the platen 6 and the shaft portion 71 once again so that the distance from the print heads 13 to the platen 6 is constant with respect to any portion of the whole platen 6.

The printer 1 may be configured such that any of a plurality of types of platen units can be replaced and mounted thereon. In this type of case, if the arrangement of each of the platen unit and the support portion 60 is appropriately adjusted, there may be no need for the operator to adjust the arrangement of the platen unit or the support portion 60 every time a platen unit is replaced with another platen unit. In a similar manner, there may be a case in which a single platen unit can be mounted on a plurality of printers in order. Also in this type of case, if the arrangement of each of the platen unit and the support portion 60 is appropriately adjusted, there may be no need for the operator to re-adjust the arrangement of the platen unit or the support portion 60 every time the platen unit is mounted on another of the printers.

When there is a manufacturing error on the printer 1 side, inadequate adjustment of the inclination of the platen 6 with respect to the pair of rails 21 and 22 is likely to appear noticeably in the lengthwise direction of the platen 6. In the printer 1, the two sets of the adjustment portions 81 and 82 are arranged on the front end side and the rear end side of the rail 21 such that they are spaced from each other. Therefore, in comparison to a case in which the two sets of the adjustment portions 81 and 82 are arranged such that there is no space between them, the operator can easily adjust the inclination of the platen 6 with respect to the pair of rails 21 and 22.

The printer 1 has a function that performs printing on a print medium, such as a T-shirt, that is larger than the size of the platen 6. The printer 1 includes the tray 8 between the platen 6 and the pair of rails 21 and 22. Therefore, the printer 1 can avoid a situation in which, of the print medium set on the printer 1, a portion that extends beyond the platen 6 becomes entangled with a member, such as the movement portion 30. From a viewpoint of movement efficiency of the platen 6, it is preferable to reduce a load applied to the movement portion 30. Therefore, it is preferable that the weight of a member that is mounted on the movement portion 30 be as light as possible. The connection portion 40 of the printer 1 also serves as a member that supports the tray 8. It is therefore possible to reduce a load applied to the movement portion 30 in comparison to a case in which a member that supports the tray 8 is provided separately from the connection portion 40. Since the connection portion 40 is formed in a T-shape, the rigidity of the connection portion 40 is larger than when the connection portion 40 is formed in a flat plate shape.

In the printer 1, of the print medium arranged on the printer 1, a portion that extends beyond the platen 6 can be supported by the tray 8. The adjustment mechanism 80 is provided below the tray 8 (provided on the side of the pair of rails 21 and 22). Further, the countersunk screws 62 and 63, which are provided above the tray 8 (provided on the platen 6 side) in order to connect the support portion 60 and the connection portion 40, are substantially on the same plane as an outer side surface of the connection portion 40. Therefore, in the printer 1, it is possible to avoid a failure that is caused by the print medium being caught on the adjustment mechanism 80. In the printer 1, the connection portion 40 and the support portion 60 are fixed using the countersunk screws 62 and 63, and thus both members may be connected precisely.

Various modifications may be made to the printer 1 of the above-described embodiment. For example, any of the following modifications (A) to (D) may be made as appropriate.

(A) The number, the shape and the arrangement of the cartridges 7 that can be mounted in the printer 1, and the liquid type etc. may be changed as appropriate. The printer 1 need not necessarily include the tray 8. The shape of the tray 8 may be changed as appropriate.

(B) The structure of the platen unit 70 may be changed as appropriate. The shape of the platen 6 may be changed to another shape, such as a square shape, as appropriate. The shaft portion 71 may be attached to a portion other than the vicinity of the central portion of the platen 6. The platen unit 70 need not necessarily include the adjustment portion 72. In place of the adjustment portion 72, the platen unit 70 may be provided with a support member and a screw member as a mechanism for adjusting the horizontal inclination of the platen. This type of mechanism is disclosed, for example, in Japanese Laid-Open Patent Publication No. 2006-240107, relevant portions of which are incorporated herein by reference.

(C) The structure of the adjustment mechanism 80 may be changed as appropriate. It is sufficient if at least three sets of adjustment portions are provided in the adjustment mechanism 80. The through hole of each of the adjustment portions may be an elliptical through hole or may be a penetration portion that is formed by a cutout. In this case, it is sufficient if the length of the penetration portion in the short side direction is smaller than the diameter of the head portion of the screw of the adjustment portion, and the length of the penetration portion in the long side direction is larger than the diameter of the screw (the diameter of the screw hole) of the adjustment portion. The movement portion 30) and the support portion 60 need not necessarily be connected by the connection portion 40 that is a separate member. For example, one of the movement portion 30 and the support portion 60 may have a connection portion that is configured to connect to the other portion. More specifically, for example, the connection portion may be formed integrally with the movement portion 30. The through hole and the screw hole that are provided in each of the adjustment portions may be respectively provided in the connection portion and a connection target (the movement portion 30 or the support portion 60), or may be respectively provided in the connection target (the movement portion 30 or the support portion 60) and the connection portion. The adjustment mechanism 80 need not necessarily be arranged below the tray 8 (arranged on the side of the pair of rails 21 and 22).

(D) The structure of the connection portion 40 may be changed as appropriate. The connection portion 40 need not necessarily extend parallel to the movement direction of the platen 6. The left-side connection portion 41 and the right-side connection portion 42 need not necessarily be provided with the engagement support portions 43 and 44, respectively. The left-side connection portion 41 and the right-side connection portion 42 may be formed integrally with each other.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

an ejection portion configured to eject liquid;

a flat plate-shaped platen arranged at a distance from the ejection portion;

a support portion configured to support the platen;

a pair of rails extending in a first direction;

a movement portion configured to move in the first direction along the pair of rails;

a connection portion configured to connect the support portion and the movement portion, the connection portion including a first connection portion and a second connection portion; and an adjustment mechanism configured to connect the support portion and the movement portion via the connection portion, allowing adjustment of an arrangement of the support portion with respect to the pair of rails, the adjustment mechanism including at least three sets of adjustment portions, each of the at least three sets of adjustment portions including a penetration portion, a screw hole and a screw, the penetration portion penetrating one of the connection portion and a connection target in a second direction, the screw hole being formed in the other of the connection portion and the connection target and extending in the second direction, the connection target being one of the support portion and the movement portion, the second direction being a direction orthogonal to the first direction, the screw hole having a diameter that is smaller than a length in a long side direction of the penetration portion, the screw having a head portion whose diameter is larger than a length in a short side direction of the penetration portion, the penetration portions or the screw holes of at least two sets of the at least three sets of adjustment portions being provided in the first connection portion, and the penetration portion or the screw hole of at least one set of the at least three sets of adjustment portions being provided in the second connection portion.

2. The printer according to claim 1, wherein the movement portion includes a first wall portion and a second wall portion each extending in the first direction, the connection target is the movement portion, the penetration portions or the screw holes of the at least two sets of the at least three sets of adjustment portions are disposed in the first wall portion, separated from each other in the first direction, and the penetration portion or the screw hole of the at least one set of the at least three sets of adjustment portions is disposed in the second wall portion.

3. The printer according to claim 1, further comprising:

a flat plate-shaped tray disposed between the platen and the pair of rails such that the tray opposes the platen, wherein the connection portion has a tray support portion configured to support the tray.

4. The printer according to claim 3, wherein the tray is supported by the connection portion on the platen side with respect to the adjustment mechanism.

5. The printer according to claim 1, further comprising:

a shaft portion configured to support the platen and configured to be mounted on the support portion, and a shaft adjustment portion configured to adjust an inclination of the shaft portion with respect to the platen.

* * * * *